US012146377B1

(12) United States Patent
Boulanger et al.

(10) Patent No.: US 12,146,377 B1
(45) Date of Patent: Nov. 19, 2024

(54) ELECTRIC ANNULAR SYSTEM AND METHOD FOR USE IN BLOWOUT PREVENTER

(71) Applicant: Schlumberger Technology Corporation, Sugar Land, TX (US)

(72) Inventors: Bruce Boulanger, Sugar Land, TX (US); Gerrit Kroesen, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/343,398

(22) Filed: Jun. 28, 2023

(51) Int. Cl.
*E21B 33/06* (2006.01)

(52) U.S. Cl.
CPC ..... *E21B 33/06* (2013.01)

(58) Field of Classification Search
CPC ..... E21B 33/06; E21B 33/085; E21B 33/061; F16K 15/14
USPC ..... 251/1.1, 1.2
See application file for complete search history.

(56) References Cited

U.S. PATENT DOCUMENTS 1,839,394 A * 1/1932 Inge ..... E21B 33/06 277/327
2,855,172 A * 10/1958 Jones ..... E21B 33/062 251/294
3,321,217 A * 5/1967 Ahlstone ..... E21B 33/038 285/379
4,095,805 A * 6/1978 Allen ..... E21B 33/06 277/327
4,372,026 A 2/1983 Mosing
4,458,876 A 7/1984 Schaeper
4,715,456 A * 12/1987 Poe, Jr. ..... E21B 19/10 188/67
6,998,724 B2 2/2006 Johansen et al.
7,156,183 B2 1/2007 Williams
7,159,662 B2 1/2007 Johansen et al.
7,389,817 B2 * 6/2008 Almdahl ..... E21B 33/064 251/1.3

(Continued)

FOREIGN PATENT DOCUMENTS

EP 2864579 A1 4/2015
EP 3039226 A2 7/2016

(Continued)

*Primary Examiner* — Daphne M Barry
(74) *Attorney, Agent, or Firm* — Kelly McKinney

(57) ABSTRACT

A technique facilitates reliable operation of a blowout preventer (BOP) system in a wide range of challenging environments. To enable dependable and rapid closing of the internal passageway of the BOP system, an annular closing system is employed. The annular closing system is fully electrically actuated and may comprise a variety of components which cooperate to provide reliable sealing of the internal passageway. Examples of those components comprise a packer which may be compressed inwardly to seal off flow along the interior passage. Additionally, a pusher mechanism is positioned in the annular closing system and is linearly shiftable such that its linear motion causes the packer to be compressed in the radially inward direction. Electrically operated linear actuators are positioned and selectively actuatable to shift the pusher mechanism linearly when causing compression of the packer.

14 Claims, 4 Drawing Sheets

(56) References Cited

U.S. PATENT DOCUMENTS

| | | | | |
|---|---|---|---|---|
| 7,395,855 | B2 * | 7/2008 | Ayling | E21B 19/10 188/67 |
| 7,779,918 | B2 * | 8/2010 | Cowie | E21B 33/063 166/85.4 |
| 7,798,466 | B2 | 9/2010 | Springett et al. | |
| 8,316,872 | B1 | 11/2012 | Milanovich | |
| 8,381,819 | B2 | 2/2013 | Fern et al. | |
| 8,621,958 | B2 | 1/2014 | Biester | |
| 8,657,011 | B2 | 2/2014 | Vyas et al. | |
| 8,776,892 | B2 | 7/2014 | Fern et al. | |
| 9,019,118 | B2 | 4/2015 | Milne et al. | |
| 9,388,657 | B2 | 7/2016 | Nelson | |
| 9,388,888 | B2 | 7/2016 | Eriksen | |
| 9,494,007 | B2 | 11/2016 | Bourgeau et al. | |
| 9,581,266 | B2 | 2/2017 | Eriksen | |
| 9,627,940 | B2 | 4/2017 | Eriksen | |
| 9,631,455 | B2 | 4/2017 | Geiger et al. | |
| 9,797,216 | B2 | 10/2017 | Rosa et al. | |
| 9,822,600 | B2 | 11/2017 | Bourgeau et al. | |
| 10,287,841 | B2 | 5/2019 | Zonoz et al. | |
| 10,301,897 | B2 | 5/2019 | Arteaga et al. | |
| 10,316,605 | B2 | 6/2019 | Bourgeau et al. | |
| 10,329,865 | B1 | 6/2019 | Baugh | |
| 10,370,914 | B2 | 8/2019 | Angstmann et al. | |
| 10,415,339 | B2 | 9/2019 | Garro et al. | |
| 10,465,466 | B2 | 11/2019 | Angstmann et al. | |
| 10,487,587 | B2 | 11/2019 | Cummins | |
| 10,570,689 | B2 | 2/2020 | Jaffrey | |
| 10,597,966 | B2 | 3/2020 | Jones et al. | |
| 10,648,268 | B2 | 5/2020 | Jaffrey et al. | |
| 10,689,933 | B2 | 6/2020 | Deul et al. | |
| 10,724,324 | B2 | 7/2020 | Boulanger | |
| 10,801,292 | B2 | 10/2020 | Biester et al. | |
| 10,900,347 | B2 | 1/2021 | Amsellem et al. | |
| 11,060,372 | B2 | 7/2021 | Bourgeau et al. | |
| 11,066,892 | B2 | 7/2021 | Gallagher et al. | |
| 11,098,551 | B2 | 8/2021 | Angstmann et al. | |
| 11,136,853 | B2 | 10/2021 | Zonoz et al. | |
| 11,156,054 | B2 | 10/2021 | Alsup et al. | |
| 11,339,624 | B2 | 5/2022 | Angstmann et al. | |
| 2004/0056229 | A1 | 3/2004 | Biester | |
| 2010/0006298 | A1 * | 1/2010 | Voss | E21B 33/038 166/368 |
| 2013/0175045 | A1 * | 7/2013 | Rytlewski | E21B 33/0355 60/327 |
| 2013/0199801 | A1 * | 8/2013 | Johnson | E21B 33/038 166/387 |
| 2013/0199802 | A1 * | 8/2013 | Weir | E21B 33/06 166/85.4 |
| 2013/0220637 | A1 | 8/2013 | Fabela | |
| 2014/0354096 | A1 | 12/2014 | Eriksen | |
| 2015/0152705 | A1 | 6/2015 | Andrew et al. | |
| 2016/0290526 | A1 | 10/2016 | Easter et al. | |
| 2017/0058623 | A1 * | 3/2017 | Jaffrey | E21B 33/06 |
| 2017/0130562 | A1 | 5/2017 | Andrew et al. | |
| 2017/0218717 | A1 | 8/2017 | Brinsden | |
| 2019/0145217 | A1 | 5/2019 | Alsup et al. | |
| 2019/0338614 | A1 | 11/2019 | Angstmann et al. | |
| 2020/0115987 | A1 * | 4/2020 | Rome | E21B 47/08 |
| 2021/0180427 | A1 | 6/2021 | Zonoz | |
| 2021/0189826 | A1 | 6/2021 | Gallagher et al. | |
| 2021/0340833 | A1 | 11/2021 | Angstmann et al. | |
| 2021/0372224 | A1 * | 12/2021 | Tyler | F16J 15/54 |
| 2022/0136356 | A1 | 5/2022 | Poveda et al. | |
| 2022/0389784 | A1 | 12/2022 | Katanguri et al. | |

FOREIGN PATENT DOCUMENTS

| | | | | |
|---|---|---|---|---|
| EP | 3099934 | A1 | 12/2016 | |
| EP | 3822514 | A1 | 5/2021 | |
| GB | 2517959 | A * | 3/2015 | E21B 33/06 |
| NO | 343133 | B1 | 11/2018 | |
| WO | 2017042152 | A1 | 3/2017 | |

* cited by examiner

ELECTRIC ANNULAR SYSTEM AND METHOD FOR USE IN BLOWOUT PREVENTER

BACKGROUND

In many oil and gas well applications, various types of equipment may be used to contain and isolate pressure in the wellbore. For example, a blowout preventer system may be installed on a wellhead to protect against blowouts. The blowout preventer has a longitudinal interior passage which allows passage of pipe, e.g. drill pipe, and other well components. Additionally, the blowout preventer has a variety of features including rams, e.g. pipe rams and shear rams, which facilitate rapid well sealing operations. Control over operation of the blowout preventer generally is achieved with various types of hydraulic controls. However, as deeper subsea wells and other types of deep wells are developed, the blowout preventer systems are required to operate in more challenging environments while at the same time improving operational availability. These challenging environments and increased requirements can render the hydraulic operating system susceptible to failure.

SUMMARY

In general, a system and method facilitate reliable operation of a blowout preventer (BOP) system in a wide range of challenging environments. To enable dependable and rapid closing of the internal passageway of the BOP system, an annular closing system is employed. The annular closing system is fully electrically actuated and may comprise a variety of components which cooperate to provide reliable sealing of the internal passageway. Examples of those components comprise a packer which may be compressed inwardly to seal off flow along the interior passage. Additionally, a pusher mechanism is positioned in the annular closing system and is linearly shiftable such that its linear motion causes the packer to be compressed in the radially inward direction. Electrically operated linear actuators are positioned and selectively actuatable to shift the pusher mechanism linearly when causing compression of the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
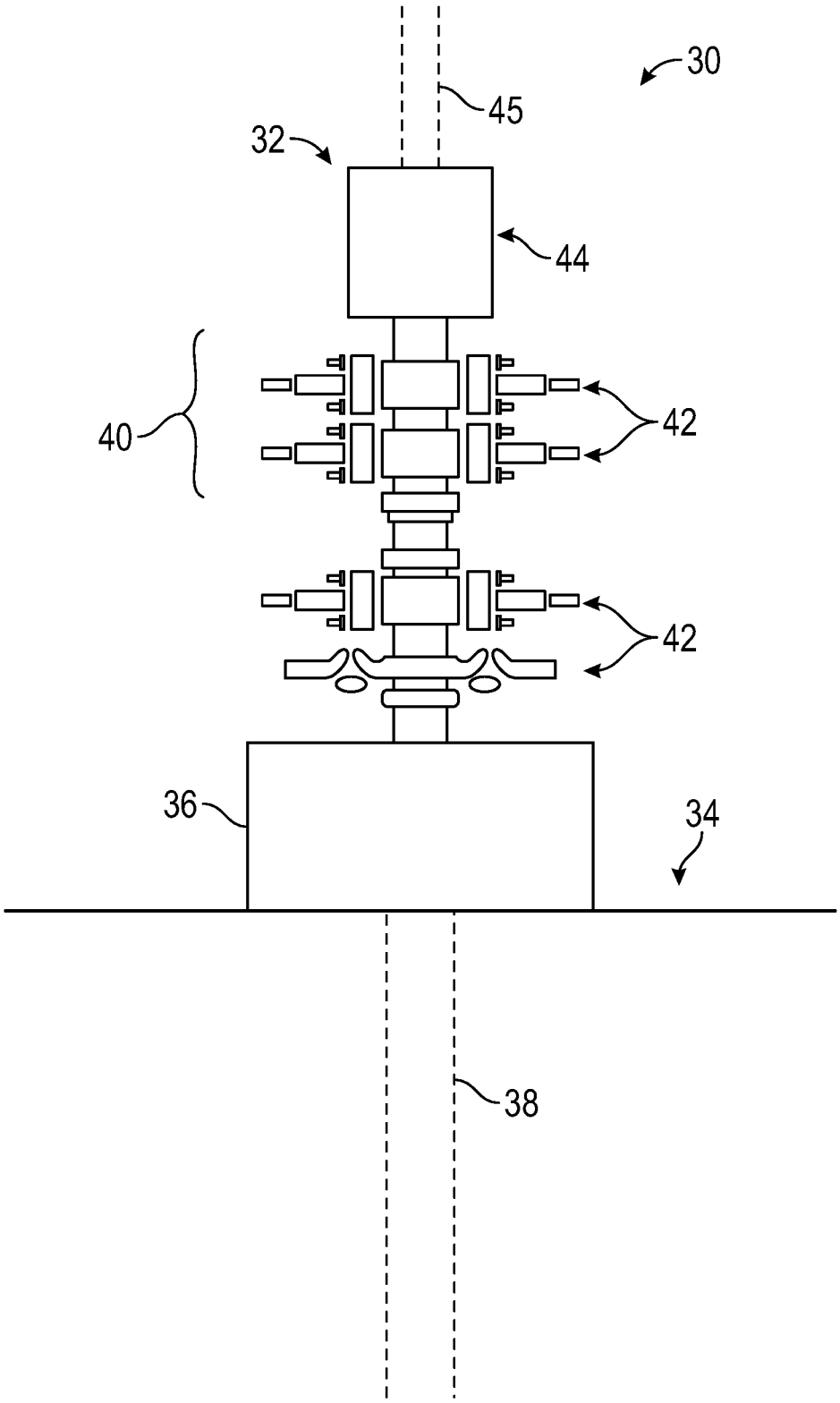
FIG. 1 is an illustration of an example of an annular closing system implemented in an overall well BOP system mounted on a wellhead above a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and method which facilitate reliable operation of a blowout preventer (BOP) system in a wide range of challenging environments. For example, the BOP system may be employed in various challenging surface environments and subsea environments where the BOP system is used to seal, control, and monitor a hydrocarbon well. Reliable operation in these types of environments is enhanced by constructing the BOP system as an electrically actuated system. This further allows well operators to move away from traditional, hydraulically powered BOP equipment.

To enable dependable and rapid closing of an internal passageway of the BOP system, an electronically actuated annular closing system is employed. The annular closing system may be actuated solely by electrical power without hydraulic actuation. Accordingly, the annular closing system utilizes a variety of components which cooperate to provide the reliable sealing of the internal passageway upon appropriate electrical input. Examples of those components comprise a packer which may be compressed inwardly to seal off flow along the interior passage. Additionally, a pusher mechanism is positioned in the annular closing system and is linearly shiftable such that its linear motion causes the packer to be compressed in the radially inward direction. Electrically operated linear actuators are positioned and selectively actuatable to shift the pusher mechanism linearly when causing compression of the packer.

In a specific embodiment, the electric annular closing system comprises a body containing the packer with a donut surrounding the packer. By way of example, the donut may be made from a suitable elastomeric material. A pusher mechanism, e.g. a pusher plate, is positioned within the annular closing system body such that linear movement of the pusher mechanism squeezes the donut. The linear movement may be in a direction generally parallel with an axis along the internal passageway of the BOP system. As the donut is squeezed by the pusher mechanism, the elastomeric material is forced inwardly which causes the packer to be compressed in a radially inward direction. Upon sufficient movement of the pusher mechanism, the packer is transitioned to a fully sealed position blocking flow along the internal passageway.

An array of electrically operated linear actuators is positioned within the body and is actuatable to move the pusher plate linearly. By way of example, each of the electrically operated linear actuators may comprise a linear operator, e.g. a plunger/piston, which may be moved linearly upon application of electrical power. The linear operator may be moved in a direction generally parallel with the axis of the internal passageway.

Referring generally to FIG. 1, a well system 30 is illustrated as comprising a BOP system 32 for providing pressure control at a well 34. In this example, the BOP system 32 is mounted on a wellhead 36, e.g. a land-based wellhead or a subsea wellhead, located above a borehole 38, e.g. a wellbore. The BOP system 32 may be arranged as a BOP stack 40 and may comprise a variety of BOP components, such as ram BOPs 42 and an annular closing system 44. By way of example, the ram BOPs 42 may comprise pipe rams and shear rams. Additionally, the annular closing system 44 may be mounted above the ram BOPs 42. As described below, the BOP system 32 may have a central, longitudinal passage for receiving tubular components 45, e.g. drill pipe or other pipe, therethrough. The annular closing system 44 is in the form of an electronically actuated annular closing system.

Figure 2:
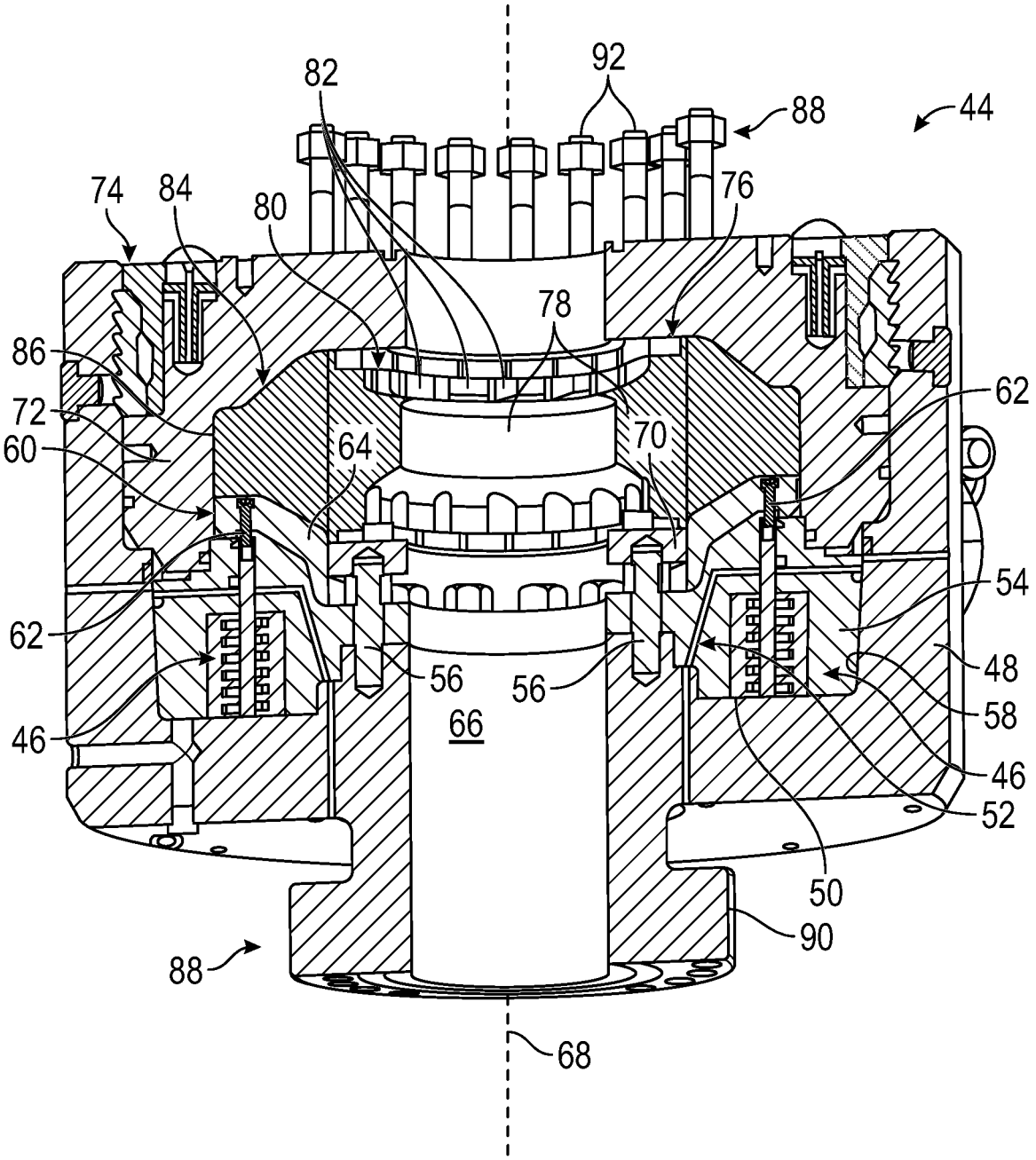
FIG. 2 is a cross-sectional illustration of an example of an annular closing system, according to an embodiment of the disclosure.

Referring generally to FIG. 2, one example of electronic annular closing system 44 is illustrated as being electrically actuatable via an array of electrically operated linear actuators 46. According to the example illustrated, the annular closing system 44 comprises a body 48 which forms the outer structure that supports components of annular closing system 44. The electrically operated linear actuators 46 are mounted within body 48 via suitable mounting structures 50, such as an internal mounting plate structure 52 and an external mounting ring 54. The internal mounting plate structure 52 may be secured to body 48 via fasteners 56 or other suitable mounting mechanisms. The external mounting ring 54 may be secured between the array of linear actuators 46 and a surrounding internal wall 58 of body 48.

In this particular embodiment, a pusher mechanism 60 is secured to the array of electrically operated linear actuators 46. For example, the pusher mechanism 60 may be secured to actuatable components of the linear actuators 46 via threaded fasteners 62 or other suitable securing mechanisms. In some embodiments, the pusher mechanism 60 may be in a form of a pusher plate 64 which extends across the array of linear actuators 46 and around a central passageway 66. It should be noted the central passageway 66 is a continuation of the internal passageway extending through BOP system 32.

In the illustrated example, the pusher plate 64 is linearly slidable in a direction generally parallel with an axis 68 of central passageway 66 while being secured radially between a packer mounting plate 70 and a top 72. The top 72 may be secured to body 48 via, for example, an actuator ring 74 or other suitable fastening mechanism. The packer mounting plate 70 may be secured within body 48 via fasteners 56 or other suitable mechanisms.

Figure 3:
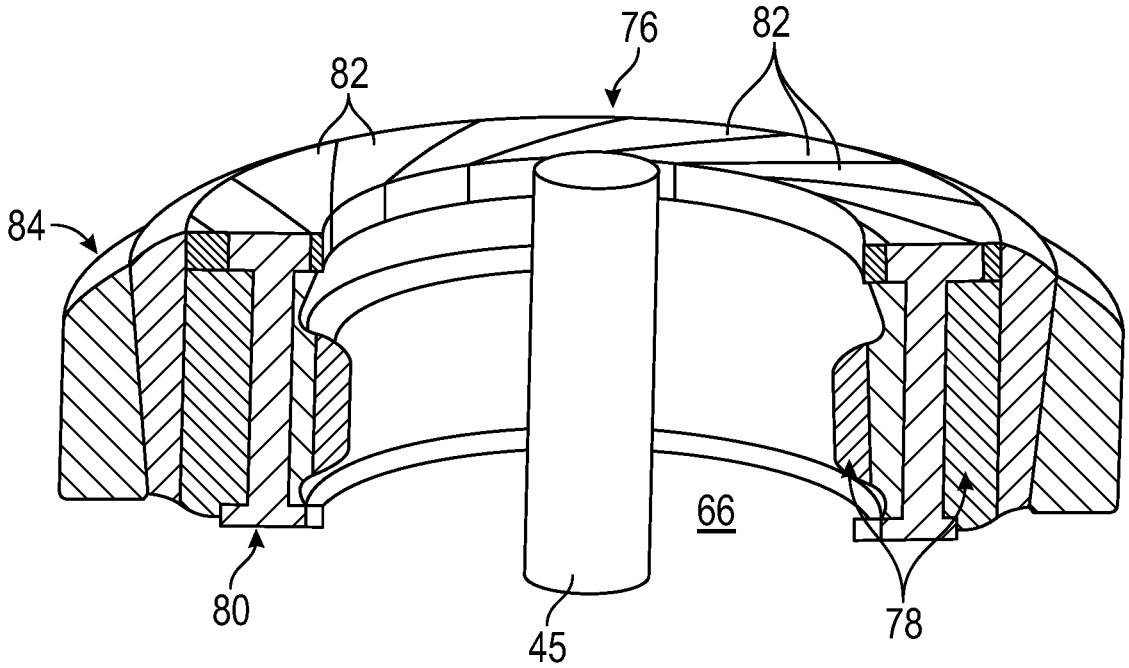
FIG. 3 is a partial schematic illustration of an example of a packer which may be utilized in the annular closing system, according to an embodiment of the disclosure.

The top 72 cooperates with body 48 to secure a packer 76 therein above packer mounting plate 70. Packer 76 may have a variety of configurations, but one example utilizes a combination of an elastomeric sealing portion 78 and a metal portion 80, e.g. a steel portion, formed by packer inserts 82 and/or other packer supporting structures, as further illustrated in FIG. 3. In the illustrated embodiment, packer 76 is surrounded by a donut 84 which may be formed of an elastomeric material or other suitable material which helps form a secure seal within the annular closing system 44.

As illustrated, the pusher mechanism 60, e.g. pusher plate 64, is movably positioned between the array of electrically operated linear actuators 46 and the donut 84. Additionally, the donut 84 is constrained via an internal wall 86 of top 72. Accordingly, when linear actuators 46 are actuated to move pusher mechanism 60 in a linear direction, e.g. parallel with axis 68, the elastomeric donut 84 is squeezed.

This squeezing action within the constraints of internal wall 86 causes the donut 84 to expand radially inwardly and to thus drive the packer 76 in a radially inward direction. Upon sufficient squeezing of donut 84, the packer 76 is forced to a set, sealed position against tubular 45 or to a sealed position within an empty central passageway 66. Regardless, flow along central passageway 66 is blocked once the packer 76 is actuated to the set/closed position.

It should be noted the electronic annular closing system 44 may be connected to various other components which may be part of the overall BOP system 32. Accordingly, the electronic annular closing system 44 may comprise mounting features 88 constructed for coupling with adjacent components. Examples of mounting features 88 include flanges 90 and mounting studs/bolts 92.

Figure 4:
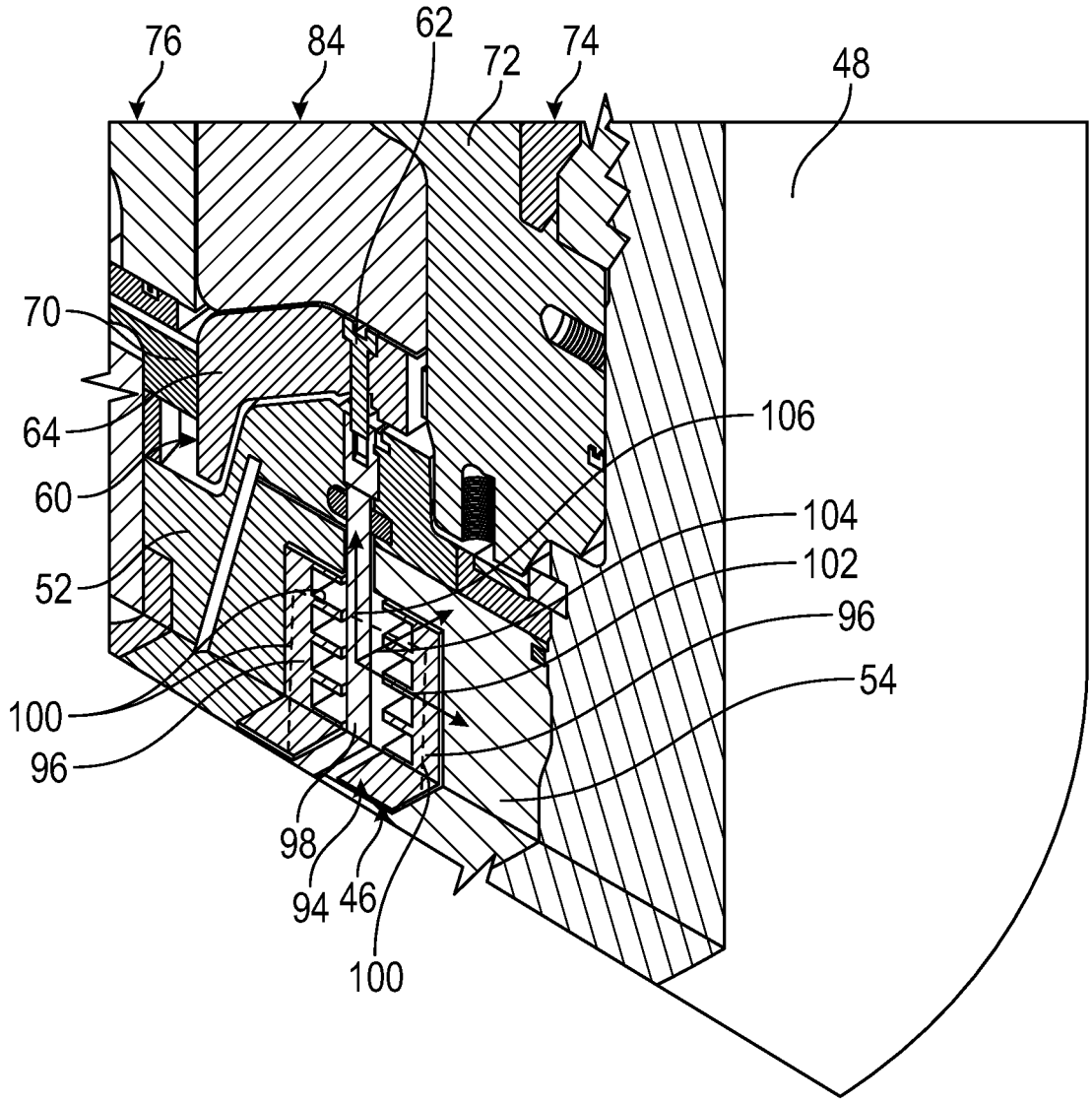
FIG. 4 is a cross-sectional illustration of an example of an electrically operated linear actuator which may be employed in an array of electrically operated linear actuators within the annular closing system, according to an embodiment of the disclosure.

Referring generally to FIG. 4, an example of one of the electrically operated linear actuators 46 is illustrated. In this embodiment, the linear actuator 46 may be in the form of an electromagnetic actuator 94, such as a "railgun" type of electrically operated linear actuator. One example of this type of electromagnetic "railgun" linear actuator 94 comprises a plurality of, e.g. two, parallel metal rails 96 with a plunger/piston 98 located between the rails 96.

When an electric current is applied to the metal rails 96 a magnetic field is created. Electric current flows through one rail 96 and returns from the opposite rail 96 through the plunger/piston 98, as illustrated by current path 100. As further illustrated in FIG. 4, the current direction across plunger/piston 98 is represented by arrow 102 and the direction of the created magnetic field is represented by arrow 104. As a result of this created magnetic field, a force is generated on the plunger/piston 98 in the direction of arrow 106.

Effectively, the magnetic field or fields are electromagnetic fields which generate a Lorentz force that accelerates the plunger/piston 98 in direction 106. The Lorentz forces are directed perpendicularly to the magnetic field (arrow 104) and perpendicularly to the direction of current flowing across the plunger/piston 98 (arrow 102). The strength of this Lorentz propulsion force on plunger/piston 98 can be found using the equation: $F-Il\times B$. In this equation, F is the strength of the Lorentz propulsion force; I represents the amount of current; l represents the distance between the rails 96; and B represents the quality and magnitude of the magnetic field.

As electric current is applied to the metal rails 96 of the array of electrically operated linear actuators 46, the plungers/pistons 98 are collectively moved in direction 106. This linear movement forces the pusher mechanism 60 in a corresponding linear movement so as to compress donut 84. As described above, the squeezing of donut 84 in this linear direction combined with the constraint provided by walls 86 forces the donut 84 to expand in a radially inward direction, thus forcing actuation of packer 76 in this radially inward direction.

The force applied to pusher mechanism 60 (and ultimately to packer 76) is further affected by the number of electrically operated linear actuators 46 in the overall array. By way of example, there may be two linear actuators 46; four linear actuators 46; six linear actuators 46; or other suitable number of linear actuators 46 to achieve the desired actuation of packer 76. If space and power permits, even greater numbers of linear actuators 46, e.g. 10 or more linear actuators 46, may be employed. As illustrated, the electrically operated linear actuators 46 may be arranged within body 48 and circumferentially around central passageway 66.

Use of electrically operated linear actuators 46 allows entirely electric actuation of packer 76. This fully electric system enables construction of the system without use of hydraulic actuator components or other types of non-electric actuator components.

Additionally, the type of structure described herein enables actuation of packer 76 with no mechanical components directly connected to the donut 84 or packer assembly 76, thus allowing central passageway 66 to open freely during, for example, stripping operations. Simple electrical actuation enables dependable, controlled squeezing or relaxing of the donut 84 and packer 76 so as to close off or open up the central passageway 66.

Depending on the specific well operation, well environment, and well equipment, the overall well system 30 may be adjusted and various configurations may be employed. For example, the BOP system 32 may comprise many types of alternate and/or additional components. Additionally, the BOP system 32 may be combined with many other types of wellheads and other well components used in, for example, land-based or subsea hydrocarbon production operations.

Furthermore, the components and arrangement of annular closing system 44 may vary according to the parameters of a given environment and/or well operation. For example, the electric actuation may be achieved by various numbers and arrangements of electrically operated linear actuators 46. The linear actuators 46 may be coupled with various types of pusher mechanisms 60 for engaging suitable types of donuts 84. Some embodiments may be constructed without the donut 84 such that the pusher mechanism 60 engages packer 76 directly or through other types of mechanisms. Additionally, packer 76 may have different types, sizes and configurations of elastomeric components, metal components, or other types of components to achieve the desired sealing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for preventing blowouts at a well, comprising:

a blowout preventer (BOP) system having an annular closing system, the annular closing system comprising:

a packer configured to be compressed inwardly to seal off flow along an interior passage of the BOP system;

a pusher plate shiftable linearly such that linear movement of the pusher plate causes the packer to be compressed inwardly; and an array of electrically operated linear actuators actuatable to move the pusher plate linearly, wherein the array of electrically operated linear actuators comprises electrically operated linear actuators which each use metal rails having a plunger therebetween, the metal rails being powered to move the plunger linearly so as to move the pusher plate.

2. The system as recited in claim 1, wherein the annular closing system comprises a donut surrounding the packer and actuatable via the pusher plate to compress the packer inwardly, the packer comprising an elastomeric sealing portion.

3. The system as recited in claim 2, wherein the packer is mounted in a body of the annular closing system.

4. The system as recited in claim 3, wherein the packer and the array of electrically operated linear actuators are secured in the body by a top mounted to the body via an actuator ring.

5. The system as recited in claim 2, wherein as the pusher plate moves linearly to squeeze the donut, the squeezing forces radially inward expansion of the donut which, in turn, forces radially inward compression of the packer.

6. The system as recited in claim 1, wherein the array of electrically operated linear actuators comprises at least two electrically operated linear actuators.

7. The system as recited in claim 1, wherein the array of electrically operated linear actuators comprises at least four electrically operated linear actuators.

8. A system for use with a well, comprising:

an annular closing system comprising:

a packer configured to be compressed inwardly to seal off flow along an interior passage;

a pusher mechanism which is linearly shiftable such that linear motion of the pusher mechanism causes the packer to be compressed in a radially inward direction; and an array of electrically operated linear actuators actuatable in a linear direction generally parallel with an axis of the interior passage, the array of electrically operated linear actuators being actuatable to shift the pusher mechanism linearly so as to cause the packer to be compressed in the radially inward direction, thus sealing off the interior passage, wherein the array of electrically operated linear actuators comprises electrically operated linear actuators which each use metal rails having a plunger therebetween, the metal rails being powered to move the plunger linearly so as to move the pusher mechanism.

9. The system as recited in claim 8, wherein the annular closing system further comprises a donut surrounding the packer, the donut being positioned for engagement by the pusher mechanism.

10. The system as recited in claim 8, wherein the packer comprises an elastomeric sealing portion.

11. The system as recited in claim 8, wherein the packer and the pusher mechanism are mounted in a body of the annular closing system.

12. The system as recited in claim 11, wherein the pusher mechanism is in the form of a pusher plate.

13. The system as recited in claim 8, further comprising a plurality of BOP rams located below the annular closing system.

14. A method, comprising:

constructing a BOP system with an annular closing system mounted on a plurality of ram BOPs;

providing the annular closing system with a packer able to compress inwardly to seal off flow along an interior passage of the BOP system;

employing a pusher mechanism which is linearly shiftable to selectively cause the packer to compress inwardly to a sealing position upon sufficient linear movement of the pusher mechanism; and coupling an array of electrically operated linear actuators to the pusher mechanism, the electrically operated linear actuators being actuatable in a linear direction to shift the pusher mechanism linearly so as to cause the packer to be compressed in the radially inward direction to the sealing position, wherein coupling the array comprises coupling a plurality of electrically operated linear actuators which are each constructed with metal rails having a plunger therebetween, the metal rails being electrically powered to move the plunger linearly so as to move the pusher plate.

* * * * *